United States Patent [19]

Simo

[11] Patent Number: 4,881,515

[45] Date of Patent: Nov. 21, 1989

[54] LATERALLY ADJUSTABLE REPLACEABLE ARROW REST

[76] Inventor: Miroslav A. Simo, 370 N. Delaplaine Rd., Riverside, Ill. 60546

[21] Appl. No.: 170,161

[22] Filed: Mar. 18, 1988

Related U.S. Application Data

[63] Continuation-in-part of Ser. No. 788,486, Oct. 17, 1985, Pat. No. 4,732,135, which is a continuation-in-part of Ser. No. 482,186, Apr. 5, 1983, Pat. No. 4,548,188.

[51] Int. Cl.[4] ..... F41C 5/00

[52] U.S. Cl. ..... 124/24 R; 124/41 A; 124/88

[58] Field of Search ..... 124/41 A, 88, 24 R, 124/23 R, 41 R; 403/383, 359

[56] References Cited

U.S. PATENT DOCUMENTS

| | | | |
|---|---|---|---|
| 3,232,286 | 2/1966 | Guyton . | |
| 3,285,237 | 11/1966 | Wolfe . | |
| 3,292,607 | 12/1966 | Hoyt | 124/41 A |
| 3,304,796 | 2/1967 | Leege | 403/383 |
| 3,482,563 | 12/1969 | Pint . | |
| 3,757,764 | 9/1973 | Ikeya . | |
| 3,769,956 | 6/1973 | Simo . | |
| 3,828,757 | 8/1974 | Finlay | 124/41 A |
| 3,871,352 | 3/1975 | Stanislawski et al. . | |
| 3,935,854 | 2/1976 | Troncosco, Jr. . | |
| 4,074,674 | 2/1978 | Simo . | |
| 4,215,666 | 8/1980 | Carroll et al. | 124/41 A |

*Primary Examiner*—Randolph A. Reese
*Assistant Examiner*—Carol I. Bordas
*Attorney, Agent, or Firm*—Thomas W. Speckman; Douglas H. Pauley

[57] ABSTRACT

An arrow rest for an archery bow which is quickly and easily replaceable and laterally adjustable in the field without any need for tools. The arrow rest has an arrow support arm which pivots upon movement of the arrow shaft and fletching across it and by a resilient arm hinge automatically returns to an initial predetermined position after discharge of the arrow. The arrow rest mounts on the end of an adjusting screw which extends through a hole in the handle portion of a bow. This invention provides easy lateral adjustment and complete replacement of the arrow rest in the field, without any need for tools, while maintaining the precise position and alignment of the arrow rest. This invention also provides an arrow rest that creates very little noise when an arrow shaft and fletching move across the arrow support arm.

47 Claims, 3 Drawing Sheets

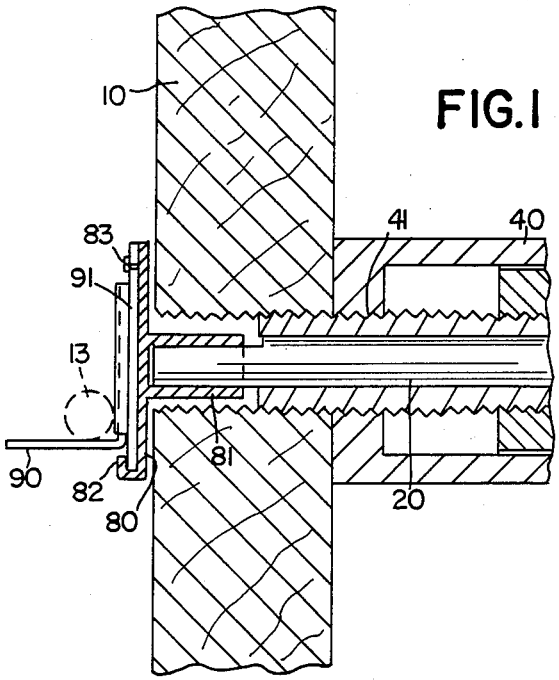
FIG.1
FIG.5
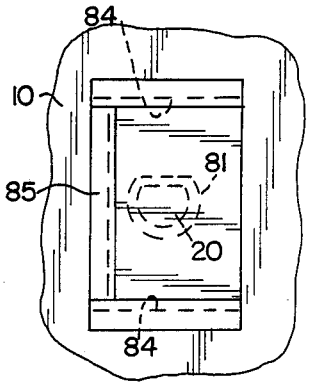
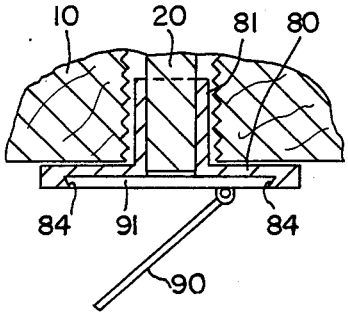
FIG.3
FIG.2
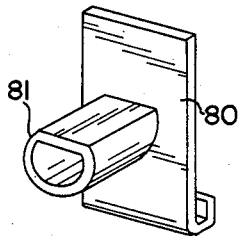
FIG.4
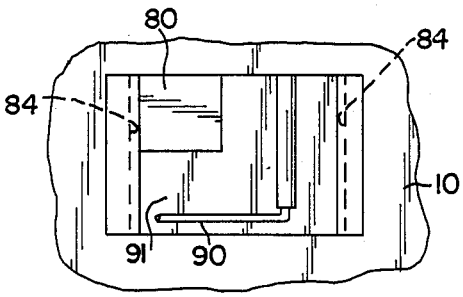

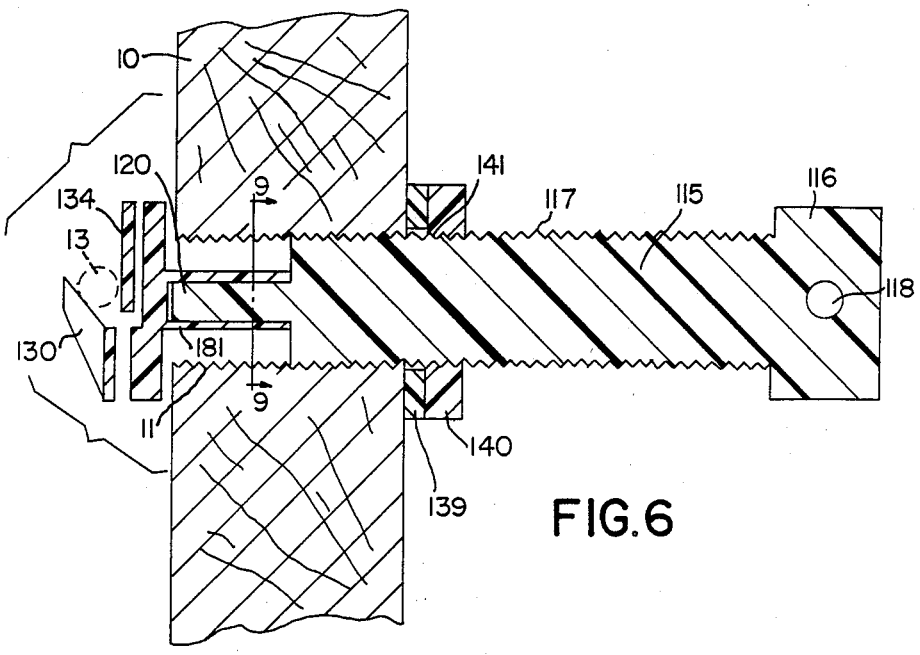
FIG.6
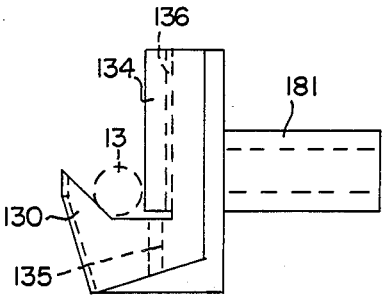
FIG.7
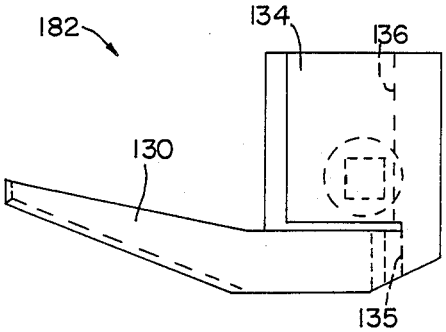
FIG.8
FIG.9
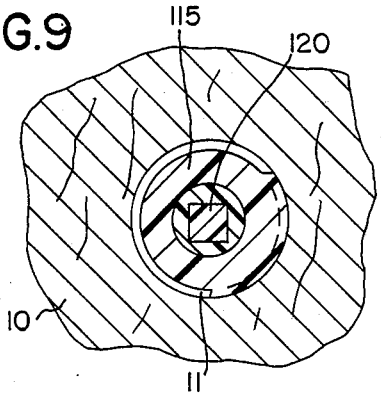

LATERALLY ADJUSTABLE REPLACEABLE ARROW REST

CROSS REFERENCE TO RELATION APPLICATIONS

This application is a continuation-in-part of my earlier applications, Ser. No. 057,383, filed June 2, 1987, to issue as U.S. Pat. No. 4,809,670, and Ser. No. 788,486, filed Oct. 17, 1985, now U.S. Pat. No. 4,732,135, which is a continuation-in-part of my earlier filed application, Ser. No. 482,186, filed Apr. 5, 1983, now U.S. Pat. No. 4,548,188.

BACKGROUND OF THE INVENTION

1. Field of the Invention

This invention relates to an arrow rest for an archery bow, and more particularly to a laterally adjustable replaceable arrow rest with an arrow support that moves away from the fletching upon release of an arrow and automatically returns to its initial position after discharge. The lateral adjustment of the arrow rest may be quickly and easily achieve d in the field without the use of tools due to the nature of the mounting of the arrow rest through the handle are of the bow. This invention provides a friction fitting between the arrow rest and mated mounting which allows the arrow rest to be instantly changed in the field, without the need for tools, while maintaining the critical position and alignment of the arrow rest.

2. Description of the Prior Art

An arrow rest is generally secured to the handle area of an archery bow, and often includes a rigid notch or ledge which supports and guides an arrow as it is discharged from the bow. However, rigid arrow rest may introduce undesirable vertical and horizontal force components to the arrow when the shaft and fletching pass over the arrow rest, causing an unwanted deflection of the arrow and damage to the fletching.

Flexible arrow rests which deflect both vertically and horizontally by spring action when the arrow passes over the arrow rest decrease this undesired deflection, as described in U.S. Pat. Nos. 4,074,674, 3,871,352 and 3,935,854. Spring biased arrow rests deflecting in a generally horizontal plane are described in U.S. Pat. Nos. 3,769,956 and 3,828,757. Also, arrow rests may be mechanically deflected away from the arrow when the arrow is shot, as described in U.S. Pat. No. 3,504,659.

An arrow may travel laterally with respect to the bow if the arrow rest is not properly aligned on the handle. Prior arrow rests which may be laterally adjusted require the use of tools or are rigid rests, as described in U.S. Pat. Nos. 3,285,237, 3,871,352, 3,232,286 and 3,757,764. A spring-biased plunger for lateral placement of an arrow on a fixed rest is described in U.S. Pat. No. 3,482,563.

Prior arrow rests have been secured to the bow handle area with adhesive, screws, or the like, and when replacement of the arrow is necessary due to breakage or wear, there is no assurance that the new arrow rest, even if of the same style as the old arrow rest, will be properly positioned for shooting without essentially complete realignment. The prior art does not suggest an arrow rest which may be easily laterally adjusted and replaced in the field without the use of tools and provide a movable arrow support arm which automatically returns to its initial position after discharge of the arrow.

SUMMARY OF THE INVENTION

It is an object of one embodiment of this invention to provide an arrow rest having an arrow support which may be deflected by movement of the shaft and fletching of an arrow and automatically returned to its initial position after discharge of the arrow.

Another object of this invention is to provide an arrow rest which may be adjusted laterally without the use of tools.

Yet another object of this invention is to provide an arrow rest which may be quickly and easily mounted and remounted assuredly in the same position and alignment with respect to the bow.

Another object of this invention is to provide an arrow rest which may be quickly and easily laterally adjusted in the field without tools and provide a deflectable arrow support which automatically returns to its initial position.

Still another object of this invention is to provide a laterally adjustable arrow rest wherein complete lateral adjustment can be achieved, that is, all the way to the bow handle without the thickness of a mounting plate or mechanical return mechanism.

Yet another object is to provide an arrow rest having lateral depression and return "plunger" action caused by an arrow shaft upon its release.

The above objects are achieved in the present invention by having an arrow rest mounted to the first end of an adjusting screw which has a first portion fixedly attachable within a transverse hole in the bow handle and an outer second portion sized to extend outwardly from the bow handle on the side away from the arrow rest when fixedly within the hole. The first end of the adjusting screw has a first connecting means. A second connecting means extends outwardly from one side of the plate portion of the arrow rest. The first and second connecting means non-rotatably mate and longitudinally seat with respect to each other. The adjusting screw provides lateral adjustment means coacting within the transverse hole in the bow handle which causes longitudinal movement of the adjusting screw and arrow rest mount with respect to the transverse hole in the bow handle. The arrow support means may be in any suitable removable arrow rest such as a flat plate having a pivotal arrow support arm mounted on one side and the plate being removably attachable to the first connecting means.

An important aspect of this invention is the provision of a laterally adjustable replaceable arrow rest having a pivotal arrow support arm which is moved out of the way by the arrow and arrow fletching and automatically returned to its initial predetermined position after discharge of the arrow. This is achieved by an adjusting screw having means for retaining a flat plate having a pivotal arrow support arm mounted on one side and on the other side a second connecting means which non-rotatably and frictionally mates and seats with the first connecting means. A one-piece arrow rest is provided with an arrow support arm which may have a generally vertical pivot portion or a pivot portion at up to 45° to the vertical and the arrow support arm outwardly extending in a direction generally opposite from the second connecting means. The arrow support arm has a grooved portion forming a resilient arm hinge which positions the support arm in a predetermined position and after deflection of the support arm, caused by movement of the arrow shaft and fletching across the arrow support arm, automatically returns the support arm to its predetermined position.

One embodiment of this invention provides a one-piece arrow rest, preferably constructed of a synthetic polymeric material, such as nylon or silicone and a low friction coating material. The one-piece arrow rest comprises a flat plate with a second connecting means on one side and an arrow support arm extending from the opposite side. The arrow support arm has sufficient length to support the arrow shaft. The arrow support arm has a grooved portion forming a resilient arm hinge near the portion where the arrow support arm meets the flat plate. The grooved portion acts as a resilient arm hinge allowing the arrow support arm to displace either horizontally or both horizontally and vertically, depending on the relative direction of the grooved portion. The angle of attachment of the grooved portion forces the arrow support arm into a predetermined position. The arrow support arm will deflect due to movement of the arrow shaft and fletching over the arrow support arm and automatically return to its initial position after discharge of the arrow.

Due to the synthetic polymeric construction material, very little noise is created as the arrow shaft and fletching moves over the arrow support arm, unlike prior arrow rests. In hunting game, it is very important to have quiet conditions for the slightest sound, such as an arrow moving over an arrow support arm, will spook an animal.

This invention provides an arrow rest with full lateral adjustment which allows the arrow rest to mount very close to the arrow side of the bow, whereby prior rests require a thickness for spring mechanisms and a mounting body which prevent lateral adjustment as close to the bow surface.

In another embodiment, lateral pressure on the arrow rest caused by a moving arrow shaft forces inwardly a contact portion of the arrow rest, that portion where the arrow shaft makes contact with vertical face of the arrow rest. Such contact portion of the arrow rest provides a depression and return action by a grooved portion forming a resilient contact hinge similar to the arrow support arm as described in the previous embodiment. The force opposing the inward force, caused by the arrow, to the contact portion can be adjusted by quickly and easily replacing one arrow rest with another that has a different strength of resilient contact hinge or construction material.

BRIEF DESCRIPTION OF THE DRAWINGS

The above mentioned and other features of this invention and the manner of obtaining them will become more apparent, and the invention itself will be best understood by reference to the following description of specific embodiments of the invention taken in conjunction with the accompanying drawings, in which:

FIG. 1 is a partial cross-sectional view showing one embodiment of an arrow rest according to this invention;

FIG. 2 is a perspective rear view of the fitting means shown in FIG. 1;

FIG. 3 is a top cross-sectional view of another embodiment of an arrow rest according to this invention;

FIG. 4 is a front view of the arrow rest shown in FIG. 3;

FIG. 5 is a front view of another embodiment of a fitting means according to this invention;

FIG. 6 is a cross-sectional view through a bow handle from the side of the archer showing one embodiment of an arrow rest of this invention;

FIG. 7 is a rear end view of the arrow rest as shown in FIG. 6;

FIG. 8 is a side view of the arrow rest as shown in FIG. 6;

FIG. 9 is a cross-sectional view along line 9—9 in FIG. 6 showing one embodiment of first connecting means and second connecting means;

DESCRIPTION OF PREFERRED EMBODIMENTS

Figure 10:
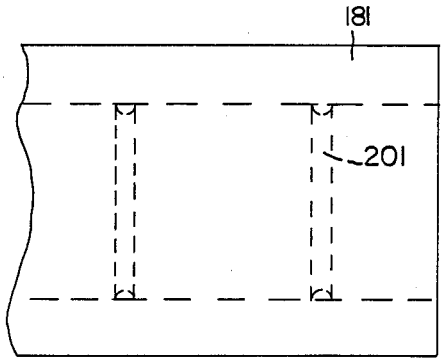
FIG. 10 is a front view of a second connecting means according to one embodiment of this invention.

U.S. Pat. Nos. 4,548,188 and 4,732,135 more fully teach embodiments of the invention shown in FIGS. 1 through 5. These patents in their entirety are incorporated herein by reference. In these embodiments, the arrow support means may have a conventional retractable arrow support wire 90 mounted on flat plate 91, many of such suitable arrow rests being well known to the art and previously adhered or otherwise fastened to the side of a bow. These patents teach that flat plate 91 of the arrow rest is removably, rigidly attached to one side of mating mounting plate 80, the other side of mating mounting plate 80 having tubular fitting means 81 snugly fitting over the end of mounting means 20 and may be maintained firmly in position by a screw into the end of mounting means 20. These patents teach a suitable mating mounting plate as shown in FIGS. 1 and 2 wherein mounting plate 80 has lip holding means 82 along the bottom edge and undercut holding means 83 extending through elongated holes in flat plate 91 to hold the retractable arrow rest flat plate 91 firmly in position. Thus, the retractable arrow rest may be readily and assuredly positioned in the same position on mating mounting plate 80. Any suitable means for holding the retractable arrow rest to mounting plate 80 may be used. Another means of holding retractable arrow rest flat plate 91 is shown in FIGS. 3 and 4 wherein opposing sides have undercut edges 84 which mate with opposing sides of flat plate 91. In a similar fashion as shown in FIG. 5, the retractable arrow rest may be slid sideways into mating mounting plate having undercut top and bottom edges 84 and front stop 85.

FIG. 6 shows one embodiment of a laterally adjustable one-piece arrow rest, having a movable arrow support arm 130 which deflects and automatically returns to an initial predetermined position. Adjusting screw 115 is installed in through opening 11 in the handle-riser portion 10 of an archery bow. Adjusting screw 115 is secured and maintained in fixed relation to the bow by adjusting screw external threads 117 engaging internal threads of through opening 11. Adjusting screw 115 can be inserted into through opening 11 from either the arrow side or side opposite the arrow side of handle-riser portion 10. Adjusting screw 115 may be firmly held in a fixed lateral position by washer 139 and lock nut 140, lock nut 140 having internal threads 141 engaging adjusting screw external threads 117 and screwed tightly against one side of washer 139, the opposite side of washer 139 being against either side of handle-riser portion 10 of an archery bow.

Adjusting screw 115 has adjusting screw end 116 positioned away from handle-riser portion 10. Adjusting screw end 116 can have an outside diameter greater than the outside diameter of adjusting screw 115. However, adjusting screw 115 has the capability of being inserted from either side of handle-riser portion 10 only if adjusting screw end 116 has an outside diameter less than or equal to the inside diameter of the internal threads of through opening 11. Adjusting screw end 116 has diametrical through hole 118. A rod inserted in through hole 118 serves two purposes. First, the rod can be used as a lever arm to torque adjusting screw 115 into through opening 11. Second, through hole 118 aligns with first connecting means 120 such that the through hole 118 or the rod inserted in through hole 118 can be used as an index for the alignment of first connecting means 120.

Rotation of adjustment screw 115 causes lateral movement of adjusting screw 115. The exterior of lock nut 140 may have flats for engagement of a wrench or may have knurls and a diameter sufficient for hand tightening, preferably the latter for quick assembly and disassembly in the field without any need for tools. When lock nut 140 is screwed tightly against washer 139 and washer 139 against the bow handle-riser portion 10, both adjusting screw 115 and lock nut 140 are firmly attached in a fixed position with respect to the bow. It is preferred that threads 117 of adjustment screws 115 extend approximately halfway through the thickness of the bow handle-riser portion 10 to provide sufficient support for adjustment screw 115 and sufficient longitudinal bearing surface between first connecting means 120 and second connecting means 181.

Second connecting means 181 is of an elongated shape and has a sleeve adapted to fit non-rotatably but longitudinally movable and seat with first connecting means 120 of adjusting screw 115. First connecting means 120 may have any suitable cross-sectional shape to non-rotatably mate with second connecting means 181. Various cross-sectional shapes for first connecting means 120 and mating second connecting means 181 may be used. A first connecting means 120 according to this embodiment is shown more clearly in the cross-sectional view of FIG. 9. The non-circular cross-sectional shape of first connecting means 120 provides a non-rotatable and longitudinally movable fit and seat within second connecting means 181. First connecting means 120 may have other cross sections such as a truncated circular cross section or a splined shape cross section. It is readily apparent that other non-circular cross-sectional shapes would also be suitable.

In this embodiment, in addition to first connecting means 120 being adjustable longitudinally with respect to bow handle-riser portion 10, pressure from the arrow shaft applied laterally to arrow rest 182 may force arrow contact portion 134 inwardly thereby causing longitudinal movement of contact portion 134 by a resilient contact hinge which returns to its original predetermined position when the force of the arrow shaft is removed. The resilient contact hinge is formed by a section of contact portion 134 having a reduced moment of inertia, with respect to the moment of inertia of adjacent sections of contact portion 134, in order to reduce the bending resistance of contact portion 134. The grooved portion of the resilient hinge reduces the force necessary to deflect the cantilever portion of contact portion 134. The force necessary to move contact portion 134 can be adjusted by quickly and easily replacing one arrow rest 182 with another arrow rest 182 having a different grooved portion forming a resilient contact or different construction material.

This invention provides a first connecting means 120 non-rotatably mated and seated with second connecting means 181. The end, facing away from the arrow shaft, of second connecting means 181 can seat against the shoulder created where the base of first connecting means 120 meets adjusting screw 115. Second connecting means 181 can also seat with respect to first connecting means 120 is the end face of first connecting means 120 contacts the plate position of second connecting means 181, or the seating can occur if the plate portion of second connecting means contacts handle-riser portion 10. Even if first connecting means 120 does not seat on second connecting means 181, an interference fit with friction and compression between both connecting means will hold arrow rest 182 in a fixed position with respect to first connecting means 120.

Figure 11:
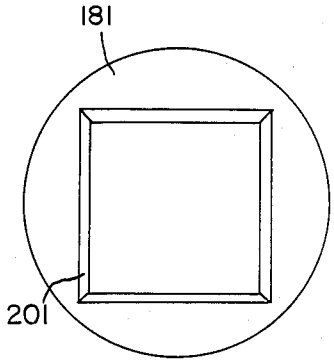
FIG. 11 is a side view of a second connecting means as shown in FIG. 10.
Figure 14:
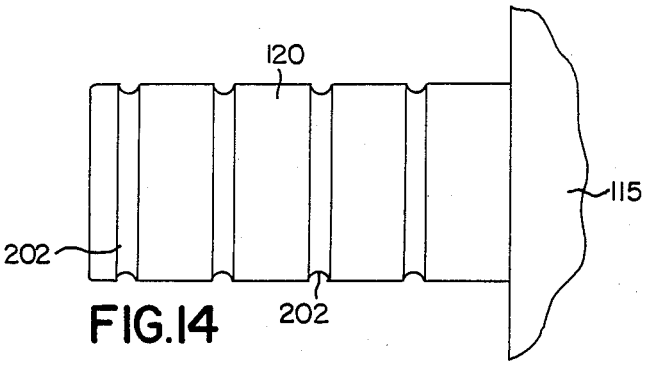
FIG. 14 is a front view of a first connecting means according to one embodiment of this invention.

In another embodiment of this invention as shown in FIG. 14, first connecting means 120 has at least one peripheral groove 202 located on the outside surface of first connecting means 120. As shown in FIGS. 10 and 11, second connecting means 181 has at least one peripheral rib 201 located on the inside surface of second connecting means 181. Peripheral rib 201 on second connecting means 181 mates with peripheral groove 202 in first connecting means 120 in a locking manner.

With such locking peripheral rib 201 and peripheral groove 202, first connecting means 120 and second connecting means 181 can longitudinally move and seat with respect to each other. Although one peripheral groove 202 and one peripheral rib 201 will accomplish such purpose, the preferred embodiment of this invention has several peripheral grooves 202 and peripheral ribs 201 spaced to provide more precise lateral adjustments. It is apparent that peripheral ribs 201 can protrude from the surface of first connecting means 120 and second connecting means 181 can have peripheral grooves 202 on the inner sleeve wall of first connecting means 120.

Figure 12:
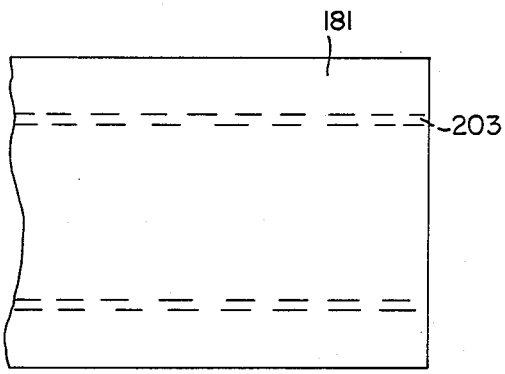
FIG. 12 is a front view of a second connecting means according to another embodiment of this invention.
Figure 13:
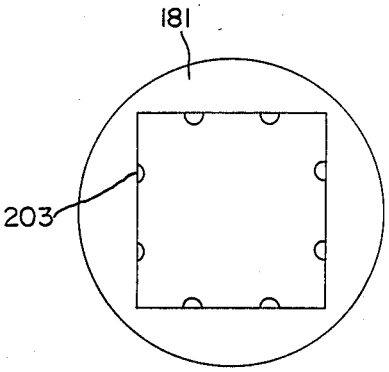
FIG. 13 is a side view of a second connecting means as shown in FIG. 12.

First connecting means 120 can have any cross-sectional shape, preferably square or polygonal, that prevents first connecting means 120 from rotating with respect to second connecting means 181. According to one embodiment of this invention, FIGS. 12 and 13 show a plurality of longitudinal crush ribs 203 located on the inner sleeve wall of second connecting means 181. Longitudinal crush ribs 203 compress and frictionally seat with an interference fit first connecting means 120 with respect to second connecting means 181. First connecting means 120 preferably has rounded off corners at the end of its pin portion thereby allowing first connecting means 120 to be easily inserted into second connecting means 181 without creating burrs. Likewise, it is apparent that longitudinal crush ribs 203 can protrude from the surface of first connecting means rib 120.

Although the preferred embodiment of this invention has two mating pieces with first connecting means 120 having the male fitting and second connecting means 181 having the female fitting, it is apparent that another embodiment of this invention may have first connecting means 120 as the female fitting and second connecting means 181 as the male fitting.

Prior arrow rests secure to bow handle-riser portion 10 with adhesives, screws, or the like, which required complete realignment once removed. In addition, except for the stock-on type, which uses double sided tape, prior arrow rests require tools for assembly and disassembly. The non-rotatable and seating connecting of this invention provides quick and easy field assembly and disassembly without any need for tools while maintaining the precise and alignment of the arrow rest.

One important of this invention provides a pivotal arrow support arm 130 as an integral one-piece part of arrow rest 182. whereby arrow support arm 130 deflects upon an arrow shaft and fletching passing over arrow support arm 130. A grooved portion forming a resilient arm hinge 135 near the base of arrow support arm 130 causes automatic return of arrow support arm 130 to its initial predetermined position after discharge of an arrow. One embodiment of arrow rest 182 is shown in FIG. 7 and FIG. 8 with arrow support arm 130 in its initial predetermined position. Arrow support arm 130 extends beyond the side of the bow handle-riser portion 10 and receives arrow shaft 13.

When the force of the arrow passing over arrow support arm 130 is terminated, the grooved portion forming a resilient arm hinge at the base of arrow support arm 130 creates a force sufficient to return arrow support arm 130 to its original predetermined position. The resilient arm hinge is formed by a section of arrow support arm 130 having a reduced moment of inertia, with respect to the moment of inertia of adjacent sections of arrow support arm 130, in order to reduce the bending resistance of arrow support arm 130. The grooves portion of the resilient hinge reduces the force necessary to deflect the cantilever portion of arrow support arm 130. Likewise, the lateral force of the arrow shaft causes contact portion 134 to move laterally toward the bow and when the force of the arrow passing over contact portion 134 is terminated, the grooved portion forming a resilient contact hinge 136 near the base of contact portion 134 creates a force sufficient to return contact portion 134 to its original predetermined position. The force, within the resilient hinges, opposing the force created by the moving arrow shaft may be controlled by varying the grooved portion or by varying the construction material used for arrow rest 182. The top of arrow support arm 130 and contact portion 134 may be covered with a low friction material that reduces the frictional drag between arrow shaft 13 and support arm 130. Suitable materials include low friction plastics, such as fluorinated hydrocarbons such as TEFLON, or any other low friction materials known to the art.

This invention provides an improved arrow rest as shown in FIGS. 6, 7, 8 and 9 where arrow support arm 130, contact portion 134, mounting plate 182 and second connecting means 181 are formed from one piece. Second connecting means 181 and first connecting means 120 having an interference fit can be quickly and easily assembled, disassembled, and reassembled without any need for tools. The non-rotatable and seated mating of second connecting means 181 with first connecting means 120 allows arrow rest 182 to be precisely positioned and aligned with respect to bow handle-riser portion 10. Adjusting screw 115 and holding nut 140 allow lateral positioning and securing of arrow rest 182 with respect to bow handle-riser portion 10.

The components of the arrow rest of this invention may be constructed to suitable materials which provide durability and resist weather. Suitable metals and moldable plastics will be readily apparent to one skilled in the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a laterally adjustable replaceable arrow rest and mounting means, a mounting means comprising: and adjusting screw having a first portion fixedly attachable within a transverse threaded through hole in a bow handle and an outer second portion sized to extend outwardly from said bow handle on a side away from an arrow when said adjusting screw is fixedly attached in said through hole, said adjusting screw first portion having external threads engageable within said threaded through hole in said bow handle, and locking means for securing a longitudinal position of said adjusting screw, said first portion of said adjusting screw having an elongated first connecting means adapted to seat and fit non-rotatable and longitudinally movable with respect to a second connecting means extending outwardly from said arrow rest.

2. In a laterally adjustable replaceable arrow rest and mounting means, a mounting means according to claim 1 wherein said locking means is a locking nut mateable with said external threads of said adjusting screw first portion and a washer, and in a secured said longitudinal position of said adjusting screw said locking nut abuts said bow handle on said side away from said arrow.

3. In a laterally adjustable replaceable arrow rest and mounting means, a mounting means according to claim 1 wherein said second portion of said adjusting screw has a knurled adjusting screw end portion.

4. In a laterally adjustable replaceable arrow rest and mounting means, a mounting means according to claim 1 wherein an adjusting screw end of said adjusting screw has a diametrical through hole, and said adjusting screw end is opposite said first portion of said adjusting screw.

5. In a laterally adjustable replaceable arrow rest and mounting means, a mounting means according to claim 1 wherein said first connecting means has a non-circular cross-sectional periphery.

6. In a laterally adjustable replaceable arrow rest and mounting means, a mounting means according to claim 5 wherein said first connecting means has at least one longitudinal crush rib on an outside surface of said non-circular cross-sectional periphery providing an interference fit with said second connecting means.

7. In a laterally adjustable replaceable arrow rest and mounting means, a mounting means according to claim 1 wherein said second connecting means further comprises a sleeve with a non-circular cross-sectional elongated opening.

8. In a laterally adjustable replaceable arrow rest and mounting means, a mounting means according to claim 7 wherein said second connecting means has at least one longitudinal crush rib on an inside surface of sand non-circular cross-sectional elongated opening providing an interference fit with said first connecting means.

9. In a laterally adjustable replaceable arrow rest and mounting means mounted on a bow handle, an arrow rest having a pivotal arrow support means which automatically returns to an initial position after discharge of an arrow comprising: said mounting means including a mounting plate and an adjustable screw which is threadably engaged with a threaded hole in the bow handle and said arrow rest including a second connecting means secured to and extending outward from an opposite side of said mounting plate, said opposite side being in a generally opposite direction from an arrow side of said mounting plate, and said second connecting means is mateable with a first connecting means on said mounting means; a pivotal arrow support arm pivotally attached to a side of said arrow rest facing toward said arrow by a resilient arm spring means formed by an arm groove in resilient polymeric material, and said arm groove forming an arm section of said arrow support arm having an arm reduced moment of inertia, with respect to an arm moment of inertia of adjacent arm sections of said arrow support arm, thereby reducing an arm force necessary to deflect a support arm cantilever portion.

10. In a laterally adjustable replaceable arrow rest and mounting means, an arrow rest according to claim 9 wherein said groove is about parallel to a long axis of a bow when a place.

11. In a laterally adjustable replaceable arrow rest and mounting means, an arrow rest according to claim 9 wherein said groove is at an angle of up to about 45° to a long axis of a bow when in place.

12. In a laterally adjustable replaceable arrow rest and mounting means, an arrow rest according to claim 9 wherein a pivotal contact portion of said arrow rest having a resilient contact spring means formed by a contact groove positioned to contact an arrow side of said arrow is attached to a side of said arrow rest facing said arrow.

13. In a laterally adjustable replaceable arrow rest and mounting means, an arrow rest according to claim 12 wherein said resilient contact spring means is formed by a contact groove in said resilient polymeric material, and said contact groove forming a contact section of said contact portion having a contact reduced moment of inertia, with respect to a contact moment of inertia of adjacent contact portion sections of said contact portion, thereby reducing a contact force necessary to deflect a contact portion cantilever portion.

14. In a laterally adjustable replaceable arrow rest and mounting means, an arrow rest according to claim 13 wherein said groove is about parallel to long axis of a bow when in place.

15. In a laterally adjustable replaceable arrow rest and mounting means, an arrow rest according to claim 9 wherein said first connecting means has a non-circular cross-sectional periphery.

16. In a laterally adjustable replaceable arrow rest and mounting means, an arrow rest according to claim 15 wherein said first connecting means has at least one longitudinal crush rib on an outside surface of said non-circular cross-sectional periphery.

17. In a laterally adjustable replaceable arrow rest and mounting means, an arrow rest according to claim 9 wherein said second connecting means further comprises a sleeve with a non-circular cross-sectional elongated opening.

18. In a laterally adjustable replaceable arrow rest and mounting means, an arrow rest according to claim 17 wherein said second connecting means is elongated and has a non-circular cross-sectional periphery.

19. In a laterally adjustable replaceable arrow rest and mounting means, an arrow rest according to claim 9 wherein said mounting means further comprises: an outside surface of said first connecting means having at least one peripheral groove, at least one peripheral rib located on an inside surface of said second connecting means, said peripheral rib mating with said peripheral groove whereby said first connecting means and said second connecting means seat with respect to each other.

20. In a laterally adjustable replaceable arrow rest and mounting means, an arrow rest according to claim 9 wherein said mounting means further comprises: an inside surface of said second connecting means having at least one peripheral groove, at least one peripheral rib located on an outside surface of said first connecting means, said peripheral rib mating with said peripheral groove whereby said second connecting means and said first connecting means seat with respect to each other.

21. A laterally adjustable replaceable arrow rest and mounting means comprising: an adjusting screw having a first portion fixedly attachable within a transverse through hole in a bow handle and an outer second portion sized to extend outwardly from said bow handle on a side away from an arrow when said adjusting screw is fixedly attached in said through hole, said adjusting screw first portion having external threads engageable with mating threads in said through hole in said bow handle, and locking means for securing a longitudinal position of said adjusting screw, said first portion of said adjusting screw having an elongated first connecting means adapted to seat and fit non-rotatably and longitudinally movable with respect to a second connecting means extending outwardly from said arrow rest whereby said arrow rest is replaceable in a substantially identical position, said arrow rest having a pivotal arrow support means which automatically returns to its initial position after discharge of an arrow, said arrow support means comprising: a pivotal arrow support arm pivotally attached to a side of said arrow rest facing toward said arrow by a resilient arm spring means formed by a groove in resilient polymeric material.

22. A laterally adjustable replaceable arrow rest and mounting means according to claim 21 wherein said locking means is a locking nut mateable with said external threads of said adjusting screw first portion and a washer, and in a secured said longitudinal position of said adjusting screw said locking nut abuts said bow handle on said side away from said arrow.

23. A laterally adjustable replaceable arrow rest and mounting means according to claim 21 wherein said second portion of said adjusting screw has a knurled adjusting screw end portion.

24. A laterally adjustable replaceable arrow rest and mounting means according to claim 21 wherein said adjusting screw end of said adjusting screw has a diameterical through hole.

25. A laterally adjustable replaceable arrow rest and mounting means according to claim 21 wherein said first connecting means has a non-circular cross-sectional periphery.

26. A laterally adjustable replaceable arrow rest and mounting means according to claim 25 wherein said first connecting means has at least one longitudinal crush rib on an outside surface of said non-circular cross-sectional periphery.

27. A laterally adjustable replaceable arrow rest and mounting means according to claim 21 wherein said second connecting means further comprises a sleeve with a non-circular cross-sectional elongated opening.

28. A laterally adjustable replaceable arrow rest and mounting means according to claim 27 wherein said second connecting means is elongated and has a non-circular cross-sectional periphery.

29. A laterally adjustable replaceable arrow rest and mounting means according to claim 21 wherein said groove is about parallel to a long axis of a bow when in place.

30. A laterally adjustable replaceable arrow rest and mounting means according to claim 21 wherein said groove is at an angle of up to about 45° to a long axis of a bow when in place.

31. A laterally adjustable replaceable arrow rest and mounting means according to claim 21 wherein a pivotal contact portion of said arrow rest having a resilient contact spring means positioned to contact an arrow side of said arrow is attached to a side of said arrow rest facing said arrow.

32. A laterally adjustable replaceable arrow rest and mounting means according to claim 31 wherein said resilient contact spring means is formed by a contact groove in resilient polymeric material.

33. A laterally adjustable replaceable arrow rest and mounting means according to claim 32 wherein said contact groove is about parallel to a long axis of a bow when said arrow rest is in place.

34. A laterally adjustable replaceable arrow rest and mounting means according to claim 21 wherein said arrow rest has a second connecting means on a side facing away from said arrow and said second connecting means is mateable with said first connecting means on said mounting means.

35. A laterally adjustable replaceable arrow rest and mounting means according to claim 34 wherein said first connecting means has a non-circular cross-sectional periphery.

36. A laterally adjustable replaceable arrow rest and mounting means according to claim 35 wherein said first connecting means has at least one longitudinal crush rib located on an outside surface of said non-circular cross-sectional periphery.

37. A laterally adjustable replaceable arrow rest and mounting means according to claim 34 wherein said second connecting means further comprises a sleeve with a non-circular cross-sectional elongated opening.

38. A laterally adjustable replaceable arrow rest and mounting means according to claim 37 wherein said second connecting means has at least one longitudinal crush rib on an inside surface of said sleeve having a non-circular cross-sectional elongated opening.

39. In an arrow rest having mounting means for fixedly mounting the arrow rest with respect to a bow, the bow having a threaded hole in a bow handle, a threaded end of the mounting means extending into the threaded hole, the arrow rest having a mounting plate, the improvement comprising: a first connecting means secured to an end of the mounting means where the mounting means comprise an adjustable screw which is threadably engaged with the threaded hole in the bow handle, an arrow rest arm extending outward from an arrow side of the mounting plate, a second connecting means secured to and extending outwardly from an opposite side of said mounting plate, said opposite side being in a generally opposite direction from said arrow side of the mounting plate, and said first connecting means longitudinally movable and adapted to seat and fit non-rotatably with respect to said second connecting means.

40. An arrow rest according to claim 39 wherein said first connecting means has a non-circular cross-sectional periphery.

41. An arrow rest according to claim 40 wherein said first connecting means has at least one longitudinal crush rib on an outside surface of said non-circular cross-sectional periphery providing an interference fit with said second connecting means.

42. An arrow rest according to claim 39 wherein said second connecting means further comprises a sleeve with a non-circular cross-sectional opening.

43. An arrow rest according to claim 42 wherein said second connecting means has at least one longitudinal cross rib on an inside surface of said noncircular cross-sectional elongated opening providing an interference fit with said first connecting means.

44. An arrow rest according to claim 39 wherein said second connecting means has a non-circular cross-sectional periphery.

45. An arrow rest according to claim 44 wherein said second connecting means has at least one longitudinal crush rib on an outside surface of said non-circular cross-sectional periphery providing an interference fit with said first connecting means.

46. An arrow rest according to claim 39 wherein said first connecting means further comprises a sleeve with a non-circular cross-sectional opening.

47. An arrow rest according to claim 46 wherein said first connecting means has at least one longitudinal crush rib on an inside surface of said non-circular cross-sectional elongated opening providing an interference fit with said second connecting means.

* * * * *